United States Patent [19]

Klingler et al.

[11] 4,361,090

[45] Nov. 30, 1982

[54] SELECTIVE INTERMITTENT LIFTER AND FILM INKING SYSTEM FOR PRINTING MACHINES

[75] Inventors: Friedrich Klingler, Kissing; Manfred Makosch, Königsbrunn, both of Fed. Rep. of Germany

[73] Assignee: M.A.N.-ROLAND Druckmaschinen Aktiengesellschaft, Offenbach am Main, Fed. Rep. of Germany

[21] Appl. No.: 240,396

[22] Filed: Mar. 4, 1981

[30] Foreign Application Priority Data

Mar. 8, 1980 [DE] Fed. Rep. of Germany ..... 3008980

[51] Int. Cl.[3] ..... B41F 31/10

[52] U.S. Cl. ..... 101/352; 101/350

[58] Field of Search ..... 101/348–352, 101/145, 247, 218, DIG. 6, 205–207, 367

[56] References Cited

U.S. PATENT DOCUMENTS

| | | | |
|---|---|---|---|
| 1,377,142 | 5/1921 | Saborsky | 101/352 |
| 1,966,311 | 7/1934 | Pearson et al. | 101/351 X |
| 2,158,474 | 5/1939 | Misuraca | 101/350 |
| 2,162,812 | 6/1939 | Harrold et al. | 101/351 |
| 2,213,419 | 9/1940 | Taylor | 101/350 |
| 2,530,282 | 11/1950 | Brodie et al. | 101/350 |
| 2,737,109 | 3/1956 | Hertsch | 101/351 X |
| 2,754,753 | 7/1956 | Chase | 101/350 |
| 3,098,437 | 7/1963 | Tyma, Jr. et al. | 101/350 |
| 3,163,110 | 12/1964 | Thompson | 101/247 |
| 3,603,254 | 9/1971 | Siebue | 101/351 X |
| 3,911,815 | 10/1975 | Banfer | 101/350 X |
| 3,916,789 | 11/1975 | Watts et al. | 101/350 |
| 3,926,116 | 12/1975 | Wildeman | 101/352 X |
| 3,965,819 | 6/1976 | Punater | 101/350 |
| 4,052,937 | 10/1977 | Lawson et al. | 101/350 |
| 4,057,013 | 11/1977 | Kaisha et al. | 101/DIG. 6 X |
| 4,129,077 | 12/1978 | Fischer | 101/350 |
| 4,130,056 | 12/1978 | Mabrouk et al. | 101/350 |
| 4,214,523 | 7/1980 | Mabrouk et al. | 101/350 X |
| 4,223,603 | 9/1980 | Faddis et al. | 101/350 |
| 4,290,359 | 9/1981 | Kapoor | 101/352 X |

*Primary Examiner*—E. H. Eickholt

*Attorney, Agent, or Firm*—Frishauf, Holtz, Goodman & Woodward

[57] ABSTRACT

To provide for selective strip or intermittent ink feed or film ink feed to an offset printing machine, a ductor roller (1) picks up ink from an ink trough (7); a lifter roller (2) is selectively positionable either in intermittent contact between the ductor roller (1) and an ink receiving transfer roller (4) when in strip or intermittent mode, and in continuous engagement with the ink receiving transfer roller (4) when in ink film mode; for ink film mode of operation, additionally, an additional transfer roller (3) is engaged with the ductor roller (1) and the lifter roller (3) in continuous engagement with the receiving transfer roller (4), the engagement between the ink transfer roller (3) and the ductor roller (1) including an ink transfer and stripping nip of suitable width. The additional transfer roller (3) is carried along by friction, the relative surface speeds between the driven ductor roller (1) and the plate cylinder being preferably about 1:60. The surface of the additional transfer roller (3) may be texturized, and made of hard material such as metal, the lifter roller being rubberized, to provide for sequential hard-soft-hard sequence of engaging surfaces.

10 Claims, 1 Drawing Figure

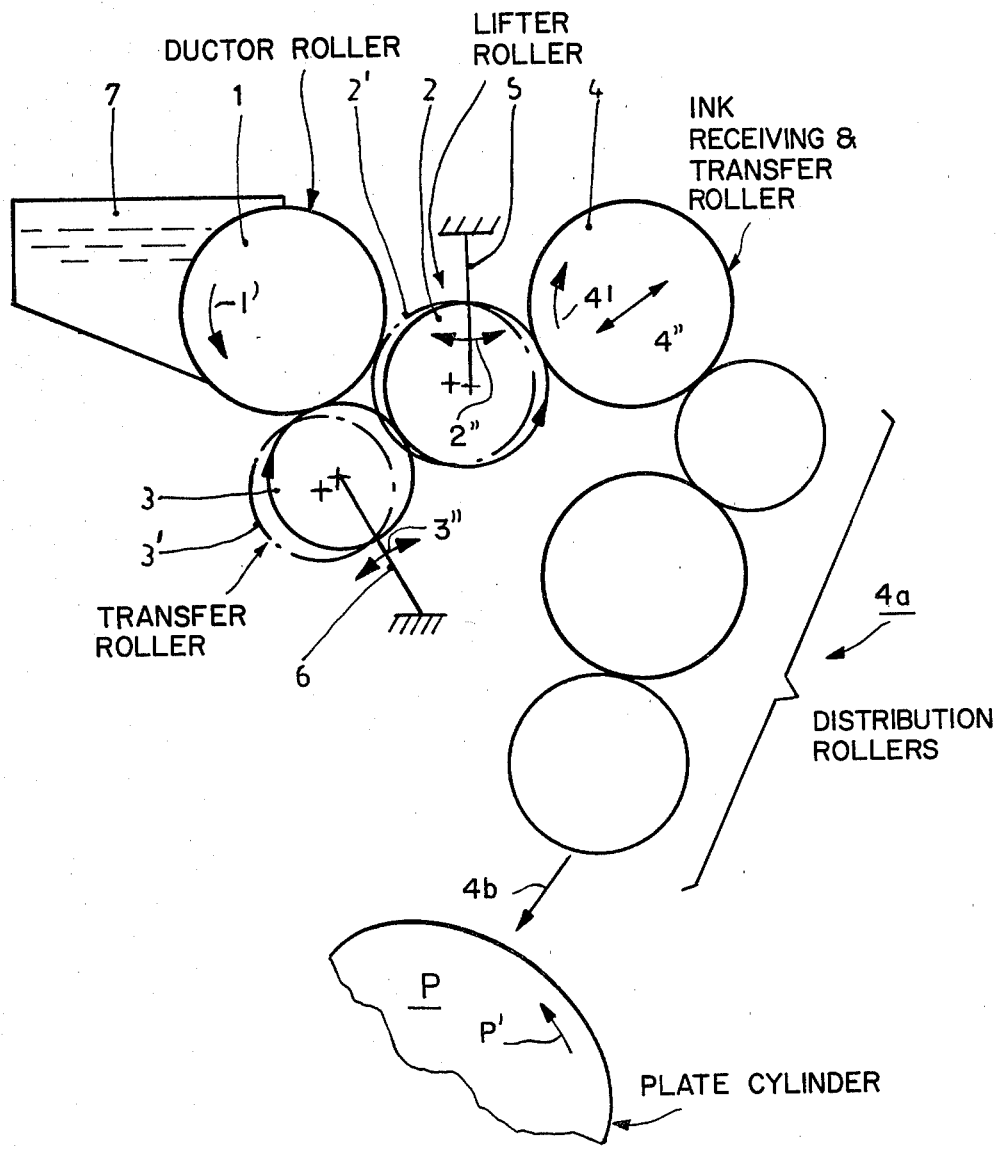
DUCTOR ROLLER
LIFTER ROLLER
INK RECEIVING & TRANSFER ROLLER
7
1
2'
2
5
4
1'
4'
4"
2"
3
3'
3"
TRANSFER ROLLER
6
4a
DISTRIBUTION ROLLERS
4b
P
P'
PLATE CYLINDER

SELECTIVE INTERMITTENT LIFTER AND FILM INKING SYSTEM FOR PRINTING MACHINES

The present invention relates to an inking system for printing machines, and more particularly to an inking system which, selectively, can be operated in an intermittent or strip ink supply or ink feed mode in which a lifter roller can be brought into alternate engagement with an ink transfer roller, or in an ink film operating mode, in which ink is transferred as a continuous film from an ink supply.

BACKGROUND

Selectively operating ink supply systems are known and have been previously proposed—see, for example, German Patent DE No. 27 03 424 to which U.S. Pat. No. 4,129,077, Fischer, assigned to the assignee of this application, corresponds, which describes an inking system for offset printing machines permitting intermittent or continuous ink film supply. A lifting roller is controlled to operate, intermittently, between an ink ductor roller and a transfer roller when in the intermittent ink supply operating mode. In order to provide for continuous ink film transfer, the ductor roller is positioned to be directly engaged with the ink transfer roller, the lifter roller remaining in continuous permanent engagement with the ductor roller and operating as an idler.

Ink ductor rollers, as well as other rollers in the inking system which are part of the ink distribution arrangement, frequently have a surface which is other than smooth, that is, is stippled, knurled, or formed with minute depressions to better receive and transmit ink. Engagement of such rollers causes difficulties at the surfaces thereof.

THE INVENTION

It is an object to provide an inking system which is operable in either intermittent, lifter operation mode, or as a continuous ink film system, and in which rollers which may, or may not, have special surface structures are used and can cooperate without mutual damage, and in which only a minimum of rollers are required for selective ink transfer from an ink trough.

Briefly, an additional ink transfer roller is provided which has a hard surface and which can be selectively positioned in ink transfer relationship to the lifter roller, when film mode of operation is desired, the lifter roller then remaining in continuous engagement with the ink transfer roller, or out of engagement with the ink lifter roller, in which second lifter or strip ink mode, the ink lifter roller will alternately contact the ductor roller or the receiving transfer roller. In continuous ink film mode of operation, the additional transfer roller receives ink from the ductor roller for subsequent transfer via the lifter roller to the receiving and transfer roller.

The system has the advantage that the sequence of soft and hard surface configurations of the various distribution rollers within the inking system can be maintained; and, additionally, that the lifter roller, in intermittent mode, will engage a receiving roller with a smooth surface. The receiving roller can be axially oscillating. Thus, wear of the surfaces of the respectively engaged rollers is minimized. In film operation, a transfer or pick-up roller with a textured surface, i.e. a surface which is not smooth, can be used, providing for appropriate ink transfer.

The lifter roller can be readily used either as a permanently engaged roller with the receiving transfer roller or in oscillating mode. Readjustment of the roller as an idler is not necessary. It is readily possible to leave the roller connected in its oscillating mechanism and merely disable the to-and-fro oscillation of the lifter, when in the lifter mode, and leave the roller in engagement with the ink receiving transfer roller. Thus, change-over is facilitated and speeded, requiring only little time. One roller less has to be adjusted in appropriate ink transferring position.

DRAWINGS

The single FIGURE is a schematic illustration of the upper portion of a selectively operable inking system in either intermittent lifter or film ink transfer mode. Parts not necessary for an understanding of the invention have been omitted or shown schematically.

An ink trough 7 is provided in which a ductor roller 1 dips, or otherwise is connected to pick up, ink therefrom. The ductor roller 1 can be engaged by a lifter roller 2 which, in turn, is intermittent engagement with a receiving and transfer roller 4. The ductor roller 1 is driven; the transfer roller 4 likewise is driven and, preferably, additionally, is axially oscillating. The lifter roller 2 is selectively moved in engagement with either the ductor roller 1 or the ink receiving and transfer roller 4 by suspension from a pivotable arm 5, to be movable from the full-line position shown at 2 in FIG. 1 to the chain-dotted position 2'. The suspension mechanism, and operation of the lifter roller in this mode, is well known. An additional transfer roller 3 is provided, suspended on or supported by a pivotable support arm arrangement or mechanism 6 to permit movement of the additional transfer roller 3 from the full-line position shown at 3 to a position 3'—illustrated in chain-dotted lines. The suspension or support mechanisms 5, 6 are shown in their simplest form; rather than pivotable support or suspensions arms, other arrangements may be used, such as mechanical, pneumatic, or hydraulic positioning systems for selective positioning of the respective rollers 2, 3 between the full-line and chain-dotted line positions. The ductor roller 1, the additional transfer roller 3, and the receiving transfer roller 4 each have hard surfaces, for example metallic surfaces. The surface of the lifter roller 2 is soft, for example a rubber surface, that is, the roller has an outside sleeve or jacket of rubber.

Operation (1) Intermittent lifter mode:

The additional transfer roller 3 is moved by the support or suspension 6 to the chain-dotted line position 3'. The lifter roller 2 is pivoted back-and-forth by the pivot suspension mechanism 5, as shown by the double arrow 2''. The receiving transfer roller 4 may operate as an oscillating friction distribution roller and preferably has a smooth surface. When the lifter roller 2 engages the receiving transfer roller 4, the soft surface of the lifter roller 2 is thus not damaged by contact with the receiving transfer roller, since it has a smooth and hard surface. In this intermittent mode of operation, the additional transfer roller 3 is out of contact or operative connection when placed in the position 3'. The movement of the transfer roller 3 is schematically shown by the double arrow 3''.

(2) Film ink supply mode:

The additional transfer roller 3 is moved in the full-line position shown in the figure and the lifter roller 2 is controlled to remain in the full-line position, as shown, the oscillating mechanism 5 being disabled or locked at the terminal position in which the lifter roller engages the receiving and transfer roller 4. The ductor roller 1 is driven at a low speed, which is less than the speed of operation of the additional transfer roller 3. An ink splitting transfer gap or nip thus will result. The thickness of this gap or nip will depend on the difference in speed between the ductor roller 1 and the additional transfer roller 3 and the desired ink transfer. In the arrangement shown, the additional transfer roller 3 will receive ink from the ductor roller 1, and will transfer the ink to the lifter roller 2 which, in turn, will transfer the ink to the receiving transfer roller for subsequent handling and distribution in a distribution roller system 4*a*, of which only three rollers are shown. The distribution roller system may be in accordance with any well known inking system, and supplies ink, as schematically shown by arrow 4*b* to a plate cylinder P of an offset printing machine.

Efficient and effective ink transfer between the ductor roller 1 and the transfer roller 3 can be obtained by texturizing the surface of the transfer roller 3. The surface of transfer roller 3, for example, may be metal. The lifter roller 2 and the transfer roller 3 need not be separately driven; they will rotate by frictional engagement with the respective rollers, and the ink thereon. Drive of rollers 1, 4 and plate cylinder P is schematically shown by arrows 1′, 4′, P′. The oscillating movement of roller 4 is shown by double arrow 4″.

The configuration of the rollers as shown permits a compact construction; the respective oscillation or positioning mechanisms 5, 6 for the lifter roller 2 and the additional transfer roller 3 can be placed at suitable locations of an ink train system.

In accordance with a preferred form of the invention, and as shown, the additional transfer roller 3 is located at least approximately in vertical alignment with respect to the ductor roller 1, that is, either above the ductor roller 1 or therebelow, as shown, so that the centers of rotation of the respective rollers 1, 3 are vertically displaced. The centers of rotation of the ductor roller 1 and the ink receiving and transfer roller 4 should be laterally displaced and may, for example, by at roughly the same level. The additional transfer roller 3, therefore, likewise, will be below the ink receiving and transfer roller 4. The lifter roller 2 is positioned between the additional transfer roller 3 and the ink receiving and transfer roller 4. This arrangement is preferred since the lifter roller 2 may expand due to heating when operating in the film mode so that the additional transfer roller 3, upon such expansion, can shift roughly tangentially with respect to the ductor roller 1. This arrangement avoids substantial changes in the nip or gap between the rollers 1, 3, 2, 4.

The system as described, basically, can thus permit easy and rapid change-over between a conventional intermittent lifter roller operating mode upon actuating or energizing the intermittent pivoting or rocking mechanism 5, and change-over to a conventional ink film operating mode by locking the lifter roller 2 in one terminal position and engaging the additional transfer roller 3.

The arrangement permits alternate sequence of rollers having hard and soft surfaces. The arrangement hard-soft-hard for the additional transfer roller 3—lifter roller 2—receiving and transfer roller 4—and a similar sequential arrangement of soft-hard-soft surfaces of the rollers permits saving of one roller, and the associated bearing and other structural elements.

The speed of the ink receiving transfer roller, which is driven, will be higher than the drive speed—considered circumferentially—of the ductor roller 1. In a preferred form, the difference in surface speeds between the ductor roller 1 and the plate cylinder P is in the order of 1:60. The sequence of surface configurations, in intermittent lifter mode, will be, subsequent to the ductor roller 1, a soft surface lifter roller 2, and a hard surface, preferably axially oscillating, receiving and transfer roller 4; and for ink film mode operation, subsequent to the ductor roller 1, hard surface transfer roller, preferably with a texturized surface, soft surface lifter roller 2, and, preferably axially oscillating, hard surface receiving and transfer roller 4.

Various changes and modifications may be made within the scope of the inventive concept.

We claim:

1. Inking system for selective intermittent ink supply, or continuous film ink supply mode of operation, having an ink trough (7);

a driven ink ductor roller (1) in ink receiving relationship with respect to the ink trough (7);

an ink distribution roller system including an ink receiving and transfer roller (4) and a plurality of distribution rollers (4*a*) for distributing ink and applying the ink to a plate cylinder (P) of a printing machine;

an ink lifter roller (2);

and means (5) selectively controlling engagement of the ink lifter roller (2) in accordance with the selected operating mode (a) in strip or intermittent mode, alternate engagement of the lifter roller (2) with the ink ductor roller (1) and the ink receiving and transfer roller (4), or (b) in film ink mode, continuous engagement with the ink transfer roller;

and comprising, in accordance with the invention, an additional ink transfer roller (3) having a hard, texturized surface;

and means (6) selectively controlling positioning of the additional ink transfer roller (3), in accordance with the selected operating mode (a) in strip or intermittent mode, out of engagement with said lifter roller (2) or (b) in film ink mode, in engagement with said ductor roller (1) and said lifter roller (2).

2. Selectively operable inking system according to claim 1, wherein the surface of the additional transfer roller (3) is metallic.

3. Selectively operable inking system according to claim 1, wherein the ink receiving and transfer roller (4) is an axially oscillating roller.

4. Selectively operable inking system according to claim 1, wherein the drive speed of the ductor roller and the drive speed of the plate cylinder are selected to provide, respectively, a ratio of linear surface speeds of 1:60 when operating in the film ink mode, and the additional transfer roller (3) is separated from the ductor roller (1) by an ink splitting gap or nip.

5. Selectively operable inking system according to claim 1, wherein the additional transfer roller (3) is placed in vertically offset position with respect to the ductor roller;

the ink receiving and transfer roller (4) is placed in laterally offset position with respect to the ductor roller and at least in approximate vertical alignment with respect to the ductor roller;

and the lifter roller (2) is positioned between the additional transfer roller (3) and the ink receiving and transfer roller (4).

6. Selectively operable inking system according to claim 1, wherein the selective positioning control means (6) positioning the additional ink transfer roller (3) place the additional transfer roller (3) out of engagement with the ductor roller (1) when the selected operating mode is the strip of intermittent mode (a) of ink supply.

7. Selectively operable inking system according to claim 6, wherein said additional ink transfer roller (3) is out of engagement with any roller of the inking system when in said strip or intermittent mode (a).

8. Selectively operable inking system according to claim 5, wherein the centers of rotation of said additional transfer roller (3), said lifter roller (2), and said receiving and transfer roller (4), when in the selected operating mode of film ink supply (b), are in at least approximate linear alignment, and the position between the additional transfer roller (3) and the ductor roller (1) is at an approximate right angle with respect to a theoretical connecting line and forming said linear alignment to provide for essentially tangential shift of the additional transfer roller (3) with respect to the ductor roller (1) upon thermal expansion of the rollers in said essentially linear alignment and thus at least approximate maintenance of an ink transfer gap or nip between the ductor roller (1) and said additional transfer roller (3).

9. Selectively operable inking system according to claim 1, wherein the sequence of surface configurations, downstream of the ductor roller, and in accordance with the selected operating mode is (a) in strip or intermittent mode, a soft surface roller formed by the lifter roller (2) in engagement with a hard surface roller formed by the ink receiving and transfer roller (4), or (b) in film ink mode, the hard, texturized surface additional transfer roller (3), a soft surface roller formed by the lifter roller (2), and a hard surface roller formed by the ink receiving and transfer roller (4), wherein the sequential surface configurations of the respective rollers will be unvarying regardless of the selected operating mode while still providing for alternate hard-soft sequence of surface engagement of the rollers.

10. Selectively operable inking system according to claim 9, wherein the surface of the additional ink transfer roller (3) is metallic.

* * * * *